US010450635B2

(12) United States Patent
Sugahara

(10) Patent No.: US 10,450,635 B2
(45) Date of Patent: Oct. 22, 2019

(54) HIGH STRENGTH AND HIGH CORROSION-RESISTANCE NICKLE-BASED ALLOY WITH SUPERIOR HOT FORGEABILITY

(71) Applicant: Hitachi Metals, Ltd., Tokyo (JP)

(72) Inventor: Katsuo Sugahara, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 16/069,379

(22) PCT Filed: Feb. 22, 2017

(86) PCT No.: PCT/JP2017/006655

§ 371 (c)(1),
(2) Date: Jul. 11, 2018

(87) PCT Pub. No.: WO2017/146114

PCT Pub. Date: Aug. 31, 2017

(65) Prior Publication Data

US 2019/0017151 A1 Jan. 17, 2019

(30) Foreign Application Priority Data

Feb. 24, 2016 (JP) ..... 2016-032660

(51) Int. Cl.
*C22C 19/05* (2006.01)

(52) U.S. Cl.
CPC ..... *C22C 19/052* (2013.01)

(58) Field of Classification Search
CPC ..... C22C 19/052; C22F 1/10
See application file for complete search history.

(56) References Cited

U.S. PATENT DOCUMENTS

| | | | |
|---|---|---|---|
| 3,046,108 | A | 7/1962 | Eiselstein |
| 3,519,419 | A | 7/1970 | Gibson et al. |
| 4,788,036 | A | 11/1988 | Eiselstein et al. |
| 6,106,643 | A | 8/2000 | Suarez et al. |
| 6,315,846 | B1 | 11/2001 | Hibner et al. |
| 2003/0049155 | A1 | 3/2003 | Pike, Jr. et al. |
| 2003/0051783 | A1 | 3/2003 | Pike, Jr. et al. |

FOREIGN PATENT DOCUMENTS

| | | |
|---|---|---|
| JP | 51-002413 | 1/1976 |
| JP | 11-217657 | 8/1999 |
| JP | 2005-082892 | 3/2005 |
| JP | 2005-240052 | 9/2005 |
| JP | 2009-256718 | 11/2009 |

OTHER PUBLICATIONS

International Search Report and the Written Opinion with English language translation of the International Search Report corresponding to International Application No. PCT/JP2017/006655 (8 pages) (dated Apr. 11, 2017).

*Primary Examiner* — Jessee R Roe
(74) *Attorney, Agent, or Firm* — Myers Bigel, P.A.

(57) ABSTRACT

Provided is a high strength and high corrosion-resistance Ni-based alloy having excellent hot forgeability, which is suitable for a member for oil drilling, the Ni-based alloy having a composition consisting of, by mass %, 42.1 to 45.5% of Cr, 0.5 to 2.5% of Nb, 1.2 to 2.0% of Ti, 0.0001 to 0.0090% of Mg, 0.001 to 0.040% of N, 0.01 to 0.50% of Mn, 0.001 to 0.050% of Si, 0.01 to 1.00% of Fe, 0.01 to 2.50% of Co, 0.001 to less than 0.500% of Cu, 0.001 to 0.050% of Al, 0.005 to less than 0.100% of V, 0.0001 to 0.0100% of B, 0.001 to 0.050% of Zr, and the balance of Ni with inevitable impurities, and the composition preferably further consists of any one of 0.1 to 1.5% of Mo, 0.1 to 1.5% of W, 0.001 to less than 0.050% of Ca, and 0.001 to less than 0.050% of Ta.

11 Claims, No Drawings

HIGH STRENGTH AND HIGH CORROSION-RESISTANCE NICKLE-BASED ALLOY WITH SUPERIOR HOT FORGEABILITY

TECHNICAL FIELD

The present invention relates to a high strength and high corrosion-resistance Ni-based alloy having excellent hot forgeability, and in particular, relates to a high strength and high corrosion-resistance Ni-based alloy having excellent hot forgeability, suitable for forming a member for oil drilling or natural gas drilling, especially a member which has a relatively large size and requires high strength and high corrosion resistance under high pressures at great depth of a few thousand meters below ground or under high temperature and corrosive environments around 200° C. that contain hydrogen sulfide or chloride.

BACKGROUND ART

Conventionally, as a material for oil drilling or natural gas drilling, materials having high strength (in particular, 0.2% proof stress) are in demand. In order to respond to such demand, a Ni alloy called "UNS N07718" (Inconel 718, a registered trademark (reference is made to Patent Document 1 entitled "Age-hardenable nickel alloy")) is most used. Here, "UNS" refers to "Unified Numbering System" defined by SAE HS-1086 and ASTM DS-566, and "N07718" refers to the number registered specifically for the alloy. This rule is also applicable to the following alloys below identified by "UNS".

The nominal composition of this alloy is, by mass %, Ni-19Cr-3Mo-5(Nb+Ta)-0.9Ti-0.5Al-19Fe. This alloy is a precipitation strengthened alloy by aging heat treatment, and thus, the maximum strength of 1140 MPa (0.2% proof stress) can be obtained for a round bar of 100 mm diameter.

However, the above UNS N07718 is inferior in corrosion resistance. An alloy having improved corrosion resistance is a Ni-based alloy called "UNS N07725" (Inconel 725, a registered trademark (reference is made to Patent Document 2, which relates to corrosion resistant high-strength nickel-based alloy)). The nominal composition of this alloy is, by mass %, Ni-21Cr-9Mo-3.3Nb-1.5Ti. This alloy is a precipitation strengthened alloy by aging heat treatment.

The above UNS N07725 has a corrosion resistance that is superior to that of UNS N07718. However, 0.2% proof stress of UNS N07725 is 965 MPa, and is inferior to that of UNS N07718. Thus, research has been conducted to further improve the 0.2% proof stress of UNS N07725 by heat treatment. For example, Patent Document 3 discloses a successful method of improving the strength of UNS N07725 (0.2% proof stress) to the maximum strength of 1186 MPa, which is equivalent to that of UNS N07718.

Recently, a high-strength corrosion resistant alloy called "UNS N07022 (corresponding to Hastelloy C-22HS, a registered trademark) has been developed (refer to Patent Document 4). The nominal composition of this alloy is, by mass %, Ni-21Cr-17Mo. This alloy is a precipitation strengthened alloy by aging heat treatment. This alloy has greatly improved corrosion resistance that is superior to that of UNS N07725. Furthermore, by this alloy being subjected to aging heat treatment in addition to cold working, the 0.2% proof stress of the alloy can be exceptionally improved. An alloy utilizing this effect is UNS N07022. The 0.2% proof stress of UNS N07022 is about 742 MPa when subjected only to aging heat treatment, and its 0.2% proof stress is improved to 1370 MPa when subjected to aging heat treatment in addition to cold working.

Patent Document 5 discloses, as a Ni-based alloy having excellent corrosion resistance, a Ni—Cr—Ti—Cu Ni-based alloy having a composition consisting of, by mass, over 40 to 50% of Cr, over 0.8 to 4% of Ti, 0.5 to 4% of Cu, 0.001 to 0.04% of N, 0.05 to 0.5% of Mn, 0.001 to 0.05% of Mg, over 0.1 to 1.0% of Fe, 0.01 to less than 0.2% of Si, and 0.01 to less than 1.5% of Al, optionally consisting of one or more elements selected from (a) and (b): (a) one or more of 0.5 to 3% of Nb and 0.5 to 3% of Ta; and (b) one or more of 0.1 to 1% of Mo and 0.1 to 1% of W, and the balance of Ni with inevitable impurities in which the C content included as inevitable impurities is adjusted to be not more than 0.05%. This Ni-based alloy has an excellent corrosion resistance against a gas containing hydrogen fluoride or sulfur compound as well as a hardness that is substantially equivalent to the hardness of conventional Ni-based alloys. Thus, if this Ni-based alloy is used as a molding material of fluorocarbon resin or PPS resin, since the Ni-based alloy has an excellent corrosion resistance against a gas containing hydrogen fluoride or sulfur compound, the wear of the mold can be decreased.

REFERENCE DOCUMENT LIST

Patent Documents

Patent Document 1: U.S. Pat. No. 3,046,108
Patent Document 2: U.S. Pat. No. 4,788,036
Patent Document 3: U.S. Pat. No. 6,315,846
Patent Document 4: JP 2005-082892 A
Patent Document 5: JP 2009-256718 A

SUMMARY OF THE INVENTION

Problem to be Solved by the Invention

As crude oil and natural gas become depleted, resource developments are focused on new oil wells that are placed in deep water or deep underground. Under such circumstances, as a material for drill members, an alloy having improved strength, in particular, having improved 0.2% proof stress, in addition to a corrosion resistance, has been demanded. Unnecessary improvement in corrosion resistance is not required, if an alloy has a corrosion resistance that exceeds the corrosion resistance of UNS N07718. In particular, an alloy having a pitting corrosion resistance against chlorides is required. Furthermore, for a member body, an alloy that has high 0.2% proof stress is required to maintain a clearance between the member body and components included in the drill member. If an alloy is merely subjected to cold working, the alloy provides an improved 0.2% proof stress due to work hardening. In addition, if an alloy is subjected to aging heat treatment in combination with the work hardening, this alloy can have a significantly improved 0.2% proof stress.

As materials for drill members, a round bar having a large diameter of about 300 mm at maximum is required; however, it is industrially impractical to have a round bar having such large diameter subjected to cold working to improve 0.2% proof stress. In fact, the products, made by applying cold working and aging heat treatment to UNS N07022, which is regarded as having an excellent corrosion resistance, are limited to pipes having thin thicknesses.

Complicated shapes are required for drill members, e.g., by forming a screw thread on the inner surface of a round bar of about 300 mm diameter×3000 mm by machining, or further by changing the thickness thereof in a tapered form, beyond merely drilling a hole in such a round bar. Thus, the material is subjected to machining prior to being subjected to hardening by aging. This is because the material after having been subjected to aging is too hard to be subjected to machining since the improvement in 0.2% proof stress by aging also brings about an improvement in hardness. Prior to aging, it is preferable that the material has a Vickers hardness of around 200 HV, which substantially corresponds to that of stainless steels.

Once a drill member is introduced into oil well drilling at great depth, it is unacceptable for the drill member to break down. This is because such a breakdown, depending on its degree, may cause damage that leads to abandonment of the oil well that is being drilled. Therefore, a round bar having a large diameter serving as a material for the outer portion of the member has to be a forged product, not a cast product. This is because a cast product of a round bar having a large diameter is not reliable, since it is difficult to completely eliminate casting defects such as shrinkage and maintain the uniformity due to segregation, etc.

As described above, as a material that is suitable for drill members, a Ni-based alloy having excellent hot forgeability as well as high strength and high corrosion resistance, which satisfies the following requirements, are demanded. Such requirements include: the alloy has a corrosion resistance that is greater than that of conventional UNS N07718 and that is equivalent to that of conventional UNS N07725; the alloy has a 0.2% proof stress that exceeds 0.2% proof stress of UNS N07718 only by aging heat treatment, not in combination with cold working; the alloy has a hardness, prior to being subjected to aging heat treatment, that substantially corresponds to the hardness of stainless steels, since the alloy is subjected to machining; and the alloy has excellent hot forgeability at a high temperature such that a large member can be formed.

Conventional alloys shown in Patent Documents 1 to 5 do not sufficiently satisfy the above requirements. That is, UNS N07718, disclosed in Patent Document 1, is inferior in corrosion resistance and in 0.2% proof stress. UNS N07725, disclosed in Patent Documents 2 and 3, is inferior in 0.2% proof stress, although not inferior in corrosion resistance. UNS N07022, disclosed in Patent Document 4, is inferior in 0.2% proof stress only by aging heat treatment, although not inferior in corrosion resistance. Ni—Cr—Ti—Cu Ni-based alloy, disclosed in Patent Document 5, is inferior in 0.2% proof stress and in hot forgeability, although not inferior in corrosion resistance, and thus, it is difficult to form a large member.

Means for Solving the Problem

In view of the above, the present inventors have researched on a Ni-based alloy capable of solving the above problems with excellent hot forgeability, high strength and high corrosion resistance compared to conventional ones. As a result, the present inventors discovered a Ni-based alloy having a composition consisting of, by mass %, 42.1 to 45.5% of Cr, 0.5 to 2.5% of Nb, 1.2 to 2.0% of Ti, 0.0001 to 0.0090% of Mg, 0.001 to 0.040% of N, 0.01 to 0.50% of Mn, 0.001 to 0.050% of Si, 0.01 to 1.00% of Fe, 0.01 to 2.50% of Co, 0.001 to less than 0.500% of Cu, 0.001 to 0.050% of Al, 0.005 to less than 0.100% of V, 0.0001 to 0.0100% of B, 0.001 to 0.050% of Zr, and optionally consisting of one or more elements selected from (a) to (c): (a) at least one of 0.1 to 1.5% of Mo and 0.1 to 1.5% of W; (b) 0.001 to less than 0.050% of Ca; and (c) 0.001 to less than 0.050% of Ta, and the balance of Ni with inevitable impurities, and the present inventors found that this alloy has excellent hot forgeabilty and corrosion resistance as well as high strength.

The present invention has been made based on the above findings. According to a first aspect, the invention provides a high strength and high corrosion-resistance Ni-based alloy having excellent hot forgeability, the alloy having a composition consisting of, by mass %, 42.1 to 45.5% of Cr,
0.5 to 2.5% of Nb,
1.2 to 2.0% of Ti,
0.0001 to 0.0090% of Mg,
0.001 to 0.040% of N,
0.01 to 0.50% of Mn,
0.001 to 0.050% of Si,
0.01 to 1.00% of Fe,
0.01 to 2.50% of Co,
0.001 to less than 0.500% of Cu,
0.001 to 0.05% of Al,
0.005 to less than 0.100% of V,
0.0001 to 0.0100% of B,
0.001 to 0.050% of Zr, and
the balance of Ni with inevitable impurities.

In a second aspect of the present invention, in the high strength and high corrosion-resistance Ni-based alloy having excellent hot forgeability according to the first aspect of the present invention, the composition further consists of, by mass %, one of more of 0.1 to 1.5% of Mo, and 0.1 to 1.5% of W.

In a third aspect of the present invention, in the high strength and high corrosion-resistance Ni-based alloy having excellent hot forgeability according to the first or second aspect of the present invention, the composition further consists of, by mass %, 0.001 to less than 0.050% of Ca.

In a fourth aspect of the present invention, in the high strength and high corrosion-resistance Ni-based alloy having excellent hot forgeability according to the first, second or third aspect of the present invention, the composition further consists of, by mass %, 0.001 to less than 0.050% of Ta.

In another aspect, the present invention provides a member for oil drilling made of the high strength and high corrosion-resistance Ni-based alloy having excellent hot forgeability according to any one of the first to fourth aspects.

Effects of Invention

As described above, the Ni-based alloy according to the present invention has, in particular, an improved 0.2% proof stress, has a corrosion resistance that is equivalent to or more than that of conventional materials, and further has an excellent hot forgeability. Thus, by using the Ni-based alloy of the present invention, it becomes possible to manufacture a large forged member having both strength and corrosion resistance.

Thus, according to the Ni-based alloy of the present invention, a drill member having both improved strength and corrosion resistance that enables drilling in deep water and deep underground can be provided, and accordingly, the present invention has excellent industrial effects.

MODE FOR CARRYING OUT THE INVENTION

Next, the reasons for limiting the content ranges of each component element in the composition of the Ni-based alloy of the present invention will be described in detail.

Cr

Cr is effective for improving corrosion resistance, in particular, pitting corrosion resistance, in an oil well environment containing chloride originated from sea water. As an index for evaluating pitting corrosion resistance, PRE (pitting resistance equivalent) value has been well-known. Further, it is known that as the PRE value increases, pitting corrosion resistance increases. For example, as shown in Table 12, the PRE values of conventional Ni-based alloys 1 to 3 are respectively about 31, 39, and 48.

Conventional Ni-based alloy 1 is a Ni-based alloy having a composition corresponding to that of UNS N07718, Conventional Ni-based alloy 2 is a Ni-based alloy having a composition corresponding to that of UNS N07725, and Conventional Ni-based alloy 3 is a Ni-based alloy having a composition corresponding to that of UNS N07022.

Thus, the Ni-based alloy of the present invention is required to have a PRE (pitting resistance equivalent) value that exceeds 31 of UNS N07718 (Conventional Ni-based alloy 1). Regarding the corrosion resistance of the Ni-based alloy, since UNS N07725 (Conventional Ni-based alloy 2) has sufficiently improved corrosion resistance, the Ni-based alloy of the present invention is only required to have PRE (pitting resistance equivalent) value of at least about 39 of UNS N07725.

If Cr, alone is used as the main component of the alloy of the present invention to ensure the above PRE (pitting resistance equivalent) value, Cr is required to be included 40% at the minimum. On the other hand, in order to improve 0.2% proof stress by aging heat treatment, precipitated phases, such as an α-Cr phase, $Ni_3Ti$ phase, and $Ni_3Nb$ phase, should play significant roles in a Ni—Cr—Nb—Ti alloy of the present invention. The present inventors have found that the effects obtained by such precipitated phases are not the same, and thus, there are no effects unless these precipitated phases are simultaneously present within the respective predetermined ranges. Of these precipitated phases, Cr serves as a main component constituting an α-Cr phase. It is desired that the Ni-based alloy of the present invention have 0.2% proof stress of 1200 MPa or more that exceeds 0.2% proof stress of UNS N07718 (Conventional Ni-based alloy 1) and UNS N07725 (Conventional Ni-based alloy 2).

To obtain a desired 0.2% proof stress, the required amount of α-Cr phase depending thereon has to be ensured. Thus, 42.1% by mass % or more (hereinafter, "% by mass %" is simply referred to as "%") of Cr should be contained. However, if the content of Cr exceeds 45.5%, the hot forgeability is decreased in the combination with Nb or Ti and at the same time, the machinability is deteriorated because the hardness in a solution heat treatment prior to aging is increased. Accordingly, the content of Cr is set to be 42.1 to 45.5%. The upper limit of the content of Cr is preferably 45.0%, and more preferably 44.6%. The lower limit of the content of Cr is preferably 43.1%, and more preferably 43.5%.

Some empirical formulas are known for the PRE (pitting resistance equivalent) as an index for pitting corrosion resistance, as described on page 9 of a journal entitled "A CORROSION MANAGEMENT AND APPLICATIONS ENGINEERING MAGAZINE FROM OUTOKUMPU 2/2012" published by the Outokumpu group. In the present invention, the PRE (pitting resistance equivalent) value was calculated by using the empirical formula expressed by:

$$\text{PRE value}=[\%\ Cr]+1.5\times([5Mo]+[\%\ W]+[\%\ Nb]+30\times[\%\ N])$$

Nb

Nb serves as a component mainly for the $Ni_3Nb$ phase of the precipitated phases, such as α-Cr phase, $Ni_3Ti$ phase, and Ni3Nb phase, formed in the Ni—Cr—Nb—Ti alloy of the present invention. A desired high 0.2% proof stress can be obtained depending on the combination of the precipitated phases, such as α-Cr phase, $Ni_3Ti$ phase, and $Ni_3Nb$ phase. In order to ensure the $Ni_3Nb$ phase required to obtain high 0.2% proof stress, 0.5% or more of Nb should be contained. However, if the content of Nb exceeds 2.5%, significant segregation occurs when the alloy is molten and hot forgeability significantly decreases.

Thus, the content of Nb is set to be 0.5 to 2.5%. The upper limit of the content of Nb is preferably 2.0%, and more preferably 1.8%. The lower limit of the content of Nb is preferably 0.8%, and more preferably 1.1%. Furthermore, Nb is also effective for improving pitting corrosion resistance, as can be understood from the empirical formula of the PRE (pitting resistance equivalent) value as described above.

Ti

Ti serves as a component mainly for the $Ni_3Ti$ phase of the precipitated phases, such as α-Cr phase, $Ni_3Ti$ phase, and $Ni_3Nb$ phase, formed in the Ni—Cr—Nb—Ti alloy of the present invention. A desired high 0.2% proof stress can be obtained depending on the combination of the precipitated phases, such as α-Cr phase, $Ni_3Ti$ phase, and $Ni_3Nb$ phase. In order to ensure the $Ni_3Ti$ phase required to obtain high 0.2% proof stress, 1.2% or more of Ti should be contained. However, if the content of Ti exceeds 2%, hot forgeability decreases and at the same time, machinability deteriorates because the hardness in a solution heat treatment prior to aging increases Thus, the content of Ti is set to be 1.2 to 2.0%. The upper limit of the content of Nb is preferably 1.9%, and more preferably 1.8%. The lower limit of the content of Ti is preferably 1.3%, and more preferably 1.4%.

Ni, Mn, and Mg

By making N, Mn and Mg coexist, it is possible to reduce the formation of the precipitated phases, such as α-Cr phase, $Ni_3Ti$ phase, and $Ni_3Nb$ phase, which might decrease the hot forgeability at 1100° C. or lower. On the other hand, as described above, the alloy of the present invention positively utilizes the precipitated phases, such as α-Cr phase, $Ni_3Ti$ phase, and $Ni_3Nb$ phase. However, if these precipitated phases are formed in a relatively short time as in a hot forging process, this may cause cracking during the manufacturing process. In particular, as the ingot becomes larger in size, such disadvantages increase.

Therefore, it is not preferable that the precipitated phases, such as α-Cr phase, $Ni_3Ti$ phase, and $Ni_3Nb$ phase, be formed in a relatively short time such as during a hot forging process. N, Mn, and Mg are effective for stabilizing γ-Ni phase, which is the matrix, for facilitating solution of Cr, NB, and Ti and for reducing the formation of the precipitated phases, such as α-Cr phase, $Ni_3Ti$ phase, and $Ni_3Nb$ phase, in a relatively short time such as during the hot forging process. These advantageous effects can maintain good hot forgeability without cracking, without a sudden increase in deformation resistance or a sudden decrease in deformability, even in a temperature range below 1100° C. However, if the content of N is less than 0.001%, then there is no effect of reducing the formation of the precipitated phases, such an α-Cr phase, $Ni_3Ti$ phase, and $Ni_3Nb$ phase, so that excessive precipitated phases might be formed during the hot forging process at 1100° C. or less, resulting in the decrease in hot forgeability. On the other hand, if the content of N exceeds 0.040%, then nitrides are produced in a short time, so that high temperature workability might decrease, and it might be difficult to process into a member.

Thus, the content of N is set to be 0.001 to 0.040%. The upper limit of the content of N is preferably 0.030%, and more preferably 0.025%. The lower limit of the content of N is preferably 0.002%, and more preferably 0.004%.

Similarly, if the content of Mn is less than 0.01%, then there is no effect of reducing the formation of the precipitated phases, such as α-Cr phase, $Ni_3Ti$ phase, and $Ni_3Nb$ phase, resulting in decrease in hot forgeability at 1100° C. or less. On the other hand, if the content of Mn exceeds 0.50%, then the effect of reducing the formation of the precipitated phases, such as α-Cr phase, $Ni_3Ti$ phase, and $Ni_3Nb$ phase becomes excessive, resulting in the inhibition of the improvement in 0.2% proof stress by aging.

Thus, the content of Mn is set to be 0.01 to 0.50%. The upper limit of the content of Mn is preferably 0.30%, and more preferably 0.25%. The lower limit of the content of Mn is preferably 0.05%, and more preferably 0.08%.

Similarly, if the content of Mg is less than 0.0001%, then there is no effect of reducing the formation of the precipitated phases, such as α-Cr phase, $Ni_3Ti$ phase, and $Ni_3Nb$ phase, resulting in decrease in hot forgeability at 1100° C. or less. On the other hand, if the content of Mg exceeds 0.0090%, then the effect of reducing the formation of the precipitated phases, such as α-Cr phase, $Ni_3Ti$ phase, and $Ni_3Nb$ phase might be saturated, and Mg might be concentrated in grain boundaries more than necessary, resulting in the decrease in hot forgeability.

Thus, the content of Mg is set to be 0.0001 to 0.0090%. The upper limit of the content of Mg is preferably 0.0050%, and more preferably 0.0045%. The lower limit of the content of Mg is preferably 0.0002%, and more preferably 0.0004%.

The effects of these three elements are not equivalent to each other, and it has been found by the present inventors that the above effects cannot be achieved unless the three elements exist at the same time and are contained within the predetermined ranges.

Si

By adding Si as a deoxidant, oxides can be reduced, so that the deformability at high temperatures, which concerns the hot forgeability, can be improved, and thus, Si is effective for decreasing the forging cracking. This effect can be achieved when 0.001% or more of Si is contained. However, if the content of Si exceeds 0.050%, then the formation of the precipitated phases, such as α-Cr phase, $Ni_3Ti$ phase, and $Ni_3Nb$ phase, might be facilitated, so that a sudden decrease of deformability in the hot forgeability might occur, and thus, the forging cracking may be likely to occur. Thus, the content of Si is set to be 0.001 to 0.050%. The upper limit of the content of Si is preferably 0.040%, and more preferably 0.030%. The lower limit of the content of Si is preferably 0.005%, and more preferably 0.008%.

Fe and Co

Fe and Co are effective for preventing forging cracking by improving toughness in a temperature range of 1200° C. or more. This effect can be achieved when 0.01% or more of Fe is contained. However, if the content of Fe exceeds 1%, then the deformability at forging might decrease. Thus, the content of Fe is set to be 0.01 to 1.00%. The upper limit of the content of Fe is preferably 0.90%, and more preferably 0.80%. The lower limit of the content of Fe is preferably 0.05%, and more preferably 0.10%.

Similarly to Fe, a comparable effect can be achieved when 0.01% or more of Co is contained. However, if the content of Co exceeds 2.50%, the machinability during solution heat treatment prior to aging heat treatment is unfavorably decreased. Thus, the content of Co is set to be 0.01 to 2.50%. The upper limit of the content of Co is preferably 1.50%, and more preferably less than 1.00%. The lower limit of the content of Co is preferably 0.08%, and more preferably 0.10%.

Cu

Cu is effective for reducing the formation of the precipitated phases, such as α-Cr phase, $Ni_3Ti$ phase, and $Ni_3Nb$ phase. This effect can be achieved when 0.001% or more of Cu is contained. However, if the content of Cu exceeds 0.500%, then the hot forgeability tends to decrease. Thus, the content of Cu is set to be 0.001 to less than 0.500%. The upper limit of the content of Cu is preferably 0.200%, and more preferably 0.090%. The lower limit of the content of Cu is preferably 0.003%, and more preferably 0.005%.

Al

Al is effective for improving 0.2% proof stress by substituting Ti with Al in the $Ni_3Ti$ phase. This effect can be achieved when 0.001% or more of Al is contained. However, if the content of Al exceeds 0.050%, then the incubation period for precipitation under a high temperature environment shifts to a shorter-time scale, resulting in an unfavorable increase in the possibility of forging cracking. Thus, the content of Al is set to be 0.001 to 0.050%. The upper limit of the content of Al is preferably 0.040%, and more preferably 0.035%. The lower limit of the content of Al is preferably 0.005%, and more preferably 0.010%.

V

V is effective for reducing the occurrence of a coarse α-Cr phase in a high temperature region, and thereby, in particular, the deformability regarding the hot forgeability can be improved, so that forging cracking can be suppressed. This effect can be achieved when 0.005% or more of V is contained. However, if the content of V exceeds 0.100%, then the deformability at a high temperature might decrease and the effect of suppressing forging cracking might disappear. Thus, the content of V is set to be 0.005 to 0.100%. The upper limit of the content of V is preferably 0.09%, and more preferably 0.08%. The lower limit of the content of V is preferably 0.007%, and more preferably 0.010%.

Zr and B

Zr and B are effective for improving the deformability in hot forging in a temperature range of 1100° C. or more, and thereby the cracking during hot forging can be reduced.

This effect can be achieved when 0.0001% or more of B is contained. However, if the content of B exceeds 0.0100%, then the deformability might decrease, and accordingly, cracking during hot forging might be induced. Thus, the content of B is set to be 0.0001 to 0.0100%. The upper limit of the content of B is preferably 0.0080%, and more preferably 0.0050%. The lower limit of B is preferably 0.0005%, and more preferably 0.0010%.

Similarly to B, a comparable effect can be achieved when 0.001% or more of Zr is contained. However, if the content of Zr exceeds 0.050%, then the deformability might decrease, and accordingly, cracking during hot forging might be induced.

Thus, the content of Zr is set to be 0.001 to 0.050%. The upper limit of the content of Zr is preferably 0.040%, and more preferably 0.030%. The lower limit of the content of Zr is preferably 0.003%, and more preferably 0.005%.

Mo and W

Since Mo and W are effective for improving pitting corrosion resistance as can be understood from the empirical formula of the PRE (pitting resistance equivalent) value as described above, Mo and W may be added as necessary.

This effect can be achieved when 0.1% or more of Mo is contained. However, if the content of Mo exceeds 1.5%, then the hot forgeability tends to decrease. Thus, the content of Mo is set to be 0.1 to 1.5%. The upper limit of the content of Mo is preferably 1.2%, and more preferably less than 1.0%. The lower limit of the content of Mo is preferably 0.2%, and more preferably 0.3%.

Similarly to Mo, a comparable effect can be achieved when 0.1% or more of W is contained. However, if the content of W exceeds 1.5%, then the hot forgeability tends to decrease. Thus, the content of W is set to be 0.1 to 1.5%. The upper limit of the content of W is preferably 1.2%, and more preferably less than 1.0%. The lower limit of the content of W is preferably 0.2%, and more preferably 0.3%.

When Mo and W are added at the same time, the total content thereof is preferably 1.5% or less.

Ca

Since Ca is effective for decreasing the forging cracking by improving the deformability in hot forgeability, Ca may be added as necessary. This effect can be achieved when 0.001% or more of Ca is contained. However, if the content of Ca is 0.050% or more, then the deformability decreases, and thus, the forging cracking may be induced. Thus, the content of Ca is set to be 0.001 to 0.050%. The upper limit of the content of Ca is preferably 0.020%, and more preferably 0.010%. The lower limit of the content of Ca is preferably 0.003%, and more preferably 0.005%.

Ta

Ta is effective for reducing the formation of the precipitated phases, such as α-Cr phase, $Ni_3Ti$ phase, and $Ni_3Nb$ phase, at 900° C. or lower. Thus, hardening can be reduced by reducing the formation of the precipitated phases when the cooling process at a solution heat treatment is not necessarily performed in a rapid manner due to the large size of a piece. Ta may be added as necessary if the machinability is intended to be improved. This effect can be achieved when 0.001% or more of Ta is contained. However, if the content of Ta is 0.05% or more, then the required amount of the precipitated phases cannot be obtained in an aging heat treatment, and therefore, a desired 0.2% proof stress cannot be obtained. Thus, the content of Ta is set to be 0.001 to less than 0.05%. The upper limit of the content of Ta is preferably 0.030%, and more preferably 0.010%. The lower limit of the content of Ta is preferably 0.002%, and more preferably 0.003%.

Inevitable Impurities:

In the manufacture of the Ni-based alloy of the present invention, it is inevitable that for example, P, S, Sn, Zn, Pb and C, introduced from dissolved raw materials, be contained. However, less than 0.01% of P, less than 0.01% of S, less than 0.01% of Sn, less than 0.01% of Zn, less than 0.002% of Pb, and less than 0.01% of C do not impair the properties of the alloy of the present invention, and thus, these constituent elements of the inevitable impurities within the ranges described above are permitted.

Below, examples of the present invention will be described.

EXAMPLES

Each of the Ni-based alloys having a predetermined component composition was melted using a general vacuum high-frequency melting furnace, and was formed into about 10 kg of a cylindrical ingot of 80 mm diameter×240 mm to obtain a Ni-based alloy material. The obtained ingots were subjected to a homogenizing heat treatment at 1230° C. for 10 hours, and then, the ingots were cooled by water, to form Ni-based alloys 1 to 46 of the present invention shown in Tables 1 to 3, and Comparative Ni-based alloys 1 to 26 shown in Tables 4 and 5. Since, in an end portion, shrinkage cavities occur in the casting process, a portion with the shrinkage cavities (about 2 kg from the upper surface) was cut off and removed so as to provide forged products. Furthermore, defects on the surface such as scars were removed by grinder grinding.

Furthermore, commercially available aging heat-treated round bars were purchased to be served as Conventional Ni-based alloys 1 to 3 shown in Table 6. Conventional Ni-based alloy 1 corresponds to an alloy defined by UNS N07718, Conventional Ni-based alloy 2 corresponds to an alloy defined by UNS N07725, and Conventional Ni-based alloy 3 corresponds to an alloy defined by UNS N07022.

TABLE 1

| Present invention Ni-based alloy (mass %) | | | | | | | | | | | | | | | | | | | |
|---|---|---|---|---|---|---|---|---|---|---|---|---|---|---|---|---|---|---|---|
| Present invention Ni-based alloy | Composition | | | | | | | | | | | | | | | | | | |
| | Cr | Nb | Ti | Mg | N | Mn | Si | Fe | Co | Cu | Al | V | B | Zr | Mo | W | Ca | Ta | Ni + inevitable impurities |
| 1 | 44.1 | 1.0 | 1.5 | 0.0004 | 0.018 | 0.12 | 0.013 | 0.11 | 0.15 | 0.008 | 0.014 | 0.011 | 0.0005 | 0.007 | — | — | — | — | balance |
| 2 | 42.1 | 1.9 | 1.7 | 0.0007 | 0.007 | 0.22 | 0.008 | 0.55 | 0.24 | 0.085 | 0.025 | 0.018 | 0.0037 | 0.017 | — | — | — | — | balance |
| 3 | 43.0 | 1.9 | 1.4 | 0.0003 | 0.009 | 0.28 | 0.019 | 0.30 | 0.75 | 0.054 | 0.031 | 0.083 | 0.0028 | 0.009 | — | — | — | — | balance |
| 4 | 43.9 | 1.0 | 1.5 | 0.0012 | 0.012 | 0.16 | 0.019 | 0.35 | 0.71 | 0.057 | 0.019 | 0.046 | 0.0029 | 0.025 | — | — | — | — | balance |
| 5 | 45.5 | 0.9 | 1.6 | 0.0015 | 0.014 | 0.05 | 0.020 | 0.32 | 0.66 | 0.066 | 0.030 | 0.015 | 0.0029 | 0.007 | — | — | — | — | balance |
| 6 | 44.9 | 0.5 | 1.8 | 0.0022 | 0.021 | 0.12 | 0.027 | 0.51 | 0.48 | 0.040 | 0.040 | 0.087 | 0.0025 | 0.016 | — | — | — | — | balance |
| 7 | 42.2 | 2.5 | 1.3 | 0.0008 | 0.017 | 0.10 | 0.024 | 0.85 | 0.47 | 0.037 | 0.017 | 0.071 | 0.0016 | 0.006 | — | — | — | — | balance |
| 8 | 43.5 | 1.8 | 1.2 | 0.0003 | 0.011 | 0.08 | 0.024 | 0.59 | 0.51 | 0.080 | 0.005 | 0.071 | 0.0011 | 0.013 | — | — | — | — | balance |
| 9 | 42.8 | 0.8 | 2.0 | 0.0030 | 0.029 | 0.23 | 0.028 | 0.34 | 0.20 | 0.027 | 0.005 | 0.050 | 0.0043 | 0.026 | — | — | — | — | balance |
| 10 | 44.3 | 1.7 | 1.5 | 0.0001 | 0.016 | 0.12 | 0.011 | 0.87 | 0.53 | 0.033 | 0.018 | 0.022 | 0.0027 | 0.011 | — | — | — | — | balance |
| 11 | 44.0 | 1.6 | 1.4 | 0.0089 | 0.011 | 0.14 | 0.026 | 0.55 | 0.25 | 0.085 | 0.030 | 0.040 | 0.0011 | 0.006 | — | — | — | — | balance |
| 12 | 43.8 | 1.7 | 1.6 | 0.0016 | 0.001 | 0.18 | 0.021 | 0.53 | 0.36 | 0.065 | 0.029 | 0.045 | 0.0026 | 0.023 | — | — | — | — | balance |
| 13 | 43.6 | 1.5 | 1.6 | 0.0022 | 0.039 | 0.10 | 0.016 | 0.73 | 0.88 | 0.023 | 0.034 | 0.087 | 0.0015 | 0.028 | — | — | — | — | balance |
| 14 | 44.1 | 1.3 | 1.5 | 0.0015 | 0.008 | 0.01 | 0.021 | 0.15 | 0.29 | 0.044 | 0.038 | 0.013 | 0.0040 | 0.024 | — | — | — | — | balance |
| 15 | 44.3 | 1.7 | 1.3 | 0.0014 | 0.019 | 0.49 | 0.026 | 0.66 | 0.31 | 0.068 | 0.006 | 0.057 | 0.0015 | 0.009 | — | — | — | — | balance |
| 16 | 43.9 | 1.5 | 1.6 | 0.0017 | 0.021 | 0.30 | 0.001 | 0.75 | 0.69 | 0.063 | 0.012 | 0.075 | 0.0037 | 0.026 | — | — | — | — | balance |

TABLE 2

| Present invention Ni-based alloy (mass %) | | | | | | | | | | | | | | | | | | | |
|---|---|---|---|---|---|---|---|---|---|---|---|---|---|---|---|---|---|---|---|
| Present invention Ni-based alloy | Composition | | | | | | | | | | | | | | | | | | |
| | Cr | Nb | Ti | Mg | N | Mn | Si | Fe | Co | Cu | Al | V | B | Zr | Mo | W | Ca | Ta | Ni + inevitable impurities |
| 17 | 44.4 | 1.3 | 1.5 | 0.0013 | 0.025 | 0.22 | 0.049 | 0.38 | 0.13 | 0.081 | 0.016 | 0.064 | 0.0021 | 0.009 | — | — | — | — | balance |
| 18 | 43.5 | 1.6 | 1.4 | 0.0015 | 0.016 | 0.09 | 0.025 | 0.01 | 0.67 | 0.023 | 0.017 | 0.075 | 0.0046 | 0.022 | — | — | — | — | balance |
| 19 | 43.7 | 1.4 | 1.6 | 0.0009 | 0.018 | 0.11 | 0.035 | 0.97 | 1.53 | 0.066 | 0.036 | 0.066 | 0.0022 | 0.010 | — | — | — | — | balance |
| 20 | 43.9 | 1.7 | 1.5 | 0.0012 | 0.014 | 0.17 | 0.027 | 0.54 | 0.01 | 0.079 | 0.029 | 0.041 | 0.0025 | 0.013 | — | — | — | — | balance |
| 21 | 44.0 | 1.5 | 1.4 | 0.0014 | 0.015 | 0.10 | 0.030 | 0.24 | 2.47 | 0.057 | 0.015 | 0.030 | 0.0047 | 0.021 | — | — | — | — | balance |
| 22 | 44.3 | 1.2 | 1.6 | 0.0010 | 0.015 | 0.23 | 0.014 | 0.42 | 0.64 | 0.001 | 0.017 | 0.057 | 0.0033 | 0.025 | — | — | — | — | balance |
| 23 | 43.9 | 1.6 | 1.4 | 0.0035 | 0.012 | 0.16 | 0.029 | 0.45 | 0.19 | 0.492 | 0.028 | 0.024 | 0.0040 | 0.018 | — | — | — | — | balance |
| 24 | 43.3 | 1.5 | 1.5 | 0.0029 | 0.016 | 0.13 | 0.022 | 0.35 | 0.54 | 0.025 | 0.001 | 0.047 | 0.0019 | 0.017 | — | — | — | — | balance |
| 25 | 43.7 | 1.7 | 1.5 | 0.0021 | 0.009 | 0.10 | 0.023 | 0.44 | 0.44 | 0.016 | 0.049 | 0.041 | 0.0006 | 0.021 | — | — | — | — | balance |
| 26 | 44.0 | 1.4 | 1.6 | 0.0017 | 0.007 | 0.06 | 0.017 | 0.74 | 0.89 | 0.008 | 0.015 | 0.005 | 0.0015 | 0.015 | — | — | — | — | balance |
| 27 | 44.1 | 1.3 | 1.7 | 0.0044 | 0.011 | 0.19 | 0.014 | 0.28 | 0.54 | 0.074 | 0.032 | 0.097 | 0.0042 | 0.009 | — | — | — | — | balance |
| 28 | 43.8 | 1.6 | 1.5 | 0.0030 | 0.012 | 0.14 | 0.011 | 0.41 | 0.26 | 0.019 | 0.033 | 0.083 | 0.0001 | 0.017 | — | — | — | — | balance |
| 29 | 43.5 | 1.8 | 1.6 | 0.0025 | 0.011 | 0.23 | 0.024 | 0.83 | 0.78 | 0.048 | 0.018 | 0.044 | 0.0097 | 0.016 | — | — | — | — | balance |
| 30 | 44.5 | 1.3 | 1.4 | 0.0048 | 0.014 | 0.27 | 0.025 | 0.56 | 0.64 | 0.016 | 0.011 | 0.060 | 0.0030 | 0.001 | — | — | — | — | balance |
| 31 | 43.4 | 1.5 | 1.5 | 0.0033 | 0.016 | 0.21 | 0.011 | 0.15 | 0.14 | 0.041 | 0.025 | 0.089 | 0.0038 | 0.048 | — | — | — | — | balance |

TABLE 3

| Present invention Ni-based alloy (mass %) | | | | | | | | | | | | | | | | | | | |
|---|---|---|---|---|---|---|---|---|---|---|---|---|---|---|---|---|---|---|---|
| Present invention Ni-based alloy | Composition | | | | | | | | | | | | | | | | | | |
| | Cr | Nb | Ti | Mg | N | Mn | Si | Fe | Co | Cu | Al | V | B | Zr | Mo | W | Ca | Ta | Ni + inevitable impurities |
| 32 | 42.9 | 1.9 | 1.3 | 0.0037 | 0.012 | 0.05 | 0.027 | 0.21 | 0.14 | 0.081 | 0.037 | 0.015 | 0.0033 | 0.010 | 0.1 | — | — | — | balance |
| 33 | 43.3 | 1.4 | 1.4 | 0.0022 | 0.014 | 0.16 | 0.020 | 0.46 | 0.20 | 0.078 | 0.031 | 0.050 | 0.0046 | 0.021 | 1.5 | — | — | — | balance |
| 34 | 43.8 | 1.2 | 1.6 | 0.0035 | 0.010 | 0.05 | 0.020 | 0.20 | 0.71 | 0.011 | 0.009 | 0.038 | 0.0013 | 0.025 | — | 0.1 | — | — | balance |
| 35 | 44.1 | 1.1 | 1.7 | 0.0054 | 0.019 | 0.06 | 0.018 | 0.43 | 0.70 | 0.071 | 0.031 | 0.064 | 0.0047 | 0.018 | — | 1.5 | — | — | balance |
| 36 | 42.8 | 1.8 | 1.4 | 0.0041 | 0.023 | 0.19 | 0.024 | 0.39 | 2.21 | 0.026 | 0.022 | 0.069 | 0.0024 | 0.022 | 0.3 | 0.4 | — | — | balance |
| 37 | 43.7 | 1.5 | 1.3 | 0.0029 | 0.027 | 0.14 | 0.016 | 0.37 | 0.39 | 0.009 | 0.013 | 0.085 | 0.0012 | 0.018 | — | — | 0.001 | — | balance |
| 38 | 43.5 | 1.7 | 1.4 | 0.0036 | 0.022 | 0.07 | 0.028 | 0.32 | 0.67 | 0.251 | 0.010 | 0.080 | 0.0011 | 0.016 | — | — | 0.047 | — | balance |
| 39 | 43.9 | 1.6 | 1.3 | 0.0014 | 0.017 | 0.13 | 0.021 | 0.74 | 0.28 | 0.054 | 0.012 | 0.033 | 0.0010 | 0.006 | — | — | — | 0.001 | balance |
| 40 | 44.1 | 1.7 | 1.5 | 0.0008 | 0.013 | 0.18 | 0.030 | 0.51 | 0.28 | 0.067 | 0.038 | 0.026 | 0.0016 | 0.005 | — | — | — | 0.006 | balance |
| 41 | 44.5 | 1.5 | 1.4 | 0.0015 | 0.023 | 0.26 | 0.009 | 0.28 | 0.21 | 0.022 | 0.026 | 0.012 | 0.0016 | 0.011 | — | — | — | 0.048 | balance |
| 42 | 43.4 | 1.3 | 1.5 | 0.0011 | 0.019 | 0.17 | 0.018 | 0.41 | 0.18 | 0.058 | 0.007 | 0.054 | 0.0028 | 0.014 | 0.7 | — | 0.012 | 0.017 | balance |
| 43 | 43.6 | 1.6 | 1.4 | 0.0028 | 0.016 | 0.05 | 0.019 | 0.86 | 0.61 | 0.084 | 0.034 | 0.039 | 0.0010 | 0.021 | — | 0.5 | 0.029 | 0.021 | balance |
| 44 | 44.3 | 1.4 | 1.6 | 0.0008 | 0.026 | 0.30 | 0.027 | 0.58 | 0.57 | 0.314 | 0.028 | 0.028 | 0.0014 | 0.014 | 0.2 | 1.2 | 0.004 | 0.005 | balance |
| 45 | 44.2 | 1.1 | 1.5 | 0.0012 | 0.020 | 0.27 | 0.009 | 0.05 | 0.14 | 0.086 | 0.036 | 0.085 | 0.0045 | 0.030 | 0.5 | — | — | 0.003 | balance |
| 46 | 43.9 | 1.8 | 1.4 | 0.0005 | 0.013 | 0.21 | 0.005 | 0.38 | 0.02 | 0.085 | 0.034 | 0.061 | 0.0016 | 0.018 | 0.5 | — | — | 0.004 | balance |

TABLE 4

| Comparative Ni-based alloy (mass %) | | | | | | | | | | | | | | | | | | | |
|---|---|---|---|---|---|---|---|---|---|---|---|---|---|---|---|---|---|---|---|
| Comparative Ni-based alloy | Composition | | | | | | | | | | | | | | | | | | |
| | Cr | Nb | Ti | Mg | N | Mn | Si | Fe | Co | Cu | Al | V | B | Zr | Mo | W | Ca | Ta | Ni + inevitable impurities |
| 1 | 41.7* | 1.1 | 1.6 | 0.0013 | 0.005 | 0.16 | 0.020 | 0.36 | 0.51 | 0.011 | 0.032 | 0.044 | 0.0017 | 0.012 | — | — | — | — | balance |
| 2 | 45.7* | 1.8 | 1.5 | 0.0006 | 0.017 | 0.25 | 0.020 | 0.74 | 0.60 | 0.043 | 0.012 | 0.078 | 0.0049 | 0.018 | — | — | — | — | balance |
| 3 | 44.9 | 0.4* | 1.7 | 0.0030 | 0.011 | 0.14 | 0.006 | 0.35 | 0.23 | 0.027 | 0.038 | 0.088 | 0.0048 | 0.009 | — | — | — | — | balance |
| 4 | 44.9 | 2.6* | 1.4 | 0.0005 | 0.023 | 0.07 | 0.005 | 0.40 | 0.65 | 0.037 | 0.021 | 0.043 | 0.0022 | 0.010 | — | — | — | — | balance |
| 5 | 44.5 | 1.9 | 1.1* | 0.0016 | 0.020 | 0.12 | 0.016 | 0.33 | 0.42 | 0.025 | 0.007 | 0.014 | 0.0041 | 0.009 | — | — | — | — | balance |
| 6 | 43.6 | 0.8 | 2.1* | 0.0020 | 0.006 | 0.05 | 0.021 | 0.63 | 0.87 | 0.084 | 0.037 | 0.046 | 0.0041 | 0.010 | — | — | — | — | balance |
| 7 | 44.3 | 1.0 | 1.6 | —* | 0.028 | 0.25 | 0.014 | 0.54 | 0.25 | 0.058 | 0.010 | 0.071 | 0.0036 | 0.024 | — | — | — | — | balance |

TABLE 4-continued

| Comparative Ni-based alloy (mass %) | | | | | | | | | | | | | | | | | | | |
|---|---|---|---|---|---|---|---|---|---|---|---|---|---|---|---|---|---|---|---|
| Comparative Ni-based alloy | Composition | | | | | | | | | | | | | | | | | | |
| | Cr | Nb | Ti | Mg | N | Mn | Si | Fe | Co | Cu | Al | V | B | Zr | Mo | W | Ca | Ta | Ni + inevitable impurities |
| 8 | 43.8 | 1.8 | 1.5 | 0.011* | 0.023 | 0.06 | 0.026 | 0.80 | 0.86 | 0.077 | 0.019 | 0.080 | 0.0020 | 0.016 | — | — | — | — | balance |
| 9 | 44.1 | 1.3 | 1.7 | 0.0043 | —* | 0.29 | 0.015 | 0.87 | 0.70 | 0.076 | 0.038 | 0.054 | 0.0034 | 0.024 | — | — | — | — | balance |
| 10 | 44.6 | 0.9 | 1.6 | 0.0022 | 0.043* | 0.11 | 0.008 | 0.76 | 0.83 | 0.061 | 0.009 | 0.052 | 0.0032 | 0.008 | — | — | — | — | balance |
| 11 | 44.5 | 1.3 | 1.6 | 0.0029 | 0.008 | —* | 0.024 | 0.27 | 0.24 | 0.019 | 0.012 | 0.050 | 0.0009 | 0.016 | — | — | — | — | balance |
| 12 | 43.9 | 0.9 | 1.5 | 0.0009 | 0.025 | 0.52* | 0.016 | 0.52 | 0.47 | 0.025 | 0.007 | 0.062 | 0.0012 | 0.013 | — | — | — | — | balance |
| 13 | 43.3 | 1.5 | 1.5 | 0.0046 | 0.013 | 0.12 | —* | 0.17 | 0.47 | 0.090 | 0.031 | 0.033 | 0.0008 | 0.007 | — | — | — | — | balance |
| 14 | 43.5 | 1.3 | 1.4 | 0.0037 | 0.023 | 0.27 | 0.053* | 0.79 | 0.73 | 0.082 | 0.031 | 0.056 | 0.0036 | 0.013 | — | — | — | — | balance |
| 15 | 44.6 | 1.0 | 1.5 | 0.0006 | 0.010 | 0.28 | 0.025 | —* | 0.83 | 0.056 | 0.011 | 0.061 | 0.0011 | 0.006 | — | — | — | — | balance |

(Note 1)
Each of Comparative Ni-based alloys does not contain any of Mo, W, Ca, and Ta.
(Note 2)
Asterisk (*) indicates out of range of composition of the present invention.

TABLE 5

| Comparative Ni-based alloy (mass %) | | | | | | | | | | | | | | | | | | | |
|---|---|---|---|---|---|---|---|---|---|---|---|---|---|---|---|---|---|---|---|
| Comparative Ni-based alloy | Composition | | | | | | | | | | | | | | | | | | |
| | Cr | Nb | Ti | Mg | N | Mn | Si | Fe | Co | Cu | Al | V | B | Zr | Mo | W | Ca | Ta | Ni + inevitable impurities |
| 16 | 44.8 | 1.1 | 1.7 | 0.0018 | 0.022 | 0.24 | 0.007 | 1.11* | 0.68 | 0.055 | 0.036 | 0.085 | 0.0032 | 0.010 | — | — | — | — | balance |
| 17 | 43.1 | 1.4 | 1.7 | 0.0020 | 0.013 | 0.21 | 0.020 | 0.64 | —* | 0.009 | 0.039 | 0.062 | 0.0017 | 0.021 | — | — | — | — | balance |
| 18 | 43.5 | 1.1 | 1.6 | 0.0039 | 0.009 | 0.23 | 0.030 | 0.13 | 2.55* | 0.015 | 0.026 | 0.031 | 0.0010 | 0.023 | — | — | — | — | balance |
| 19 | 45.0 | 1.9 | 1.6 | 0.0038 | 0.010 | 0.17 | 0.005 | 0.53 | 0.90 | —* | 0.029 | 0.082 | 0.0010 | 0.005 | — | — | — | — | balance |
| 20 | 44.3 | 2.0 | 1.4 | 0.0040 | 0.015 | 0.12 | 0.025 | 0.45 | 0.81 | 0.52* | 0.023 | 0.040 | 0.0040 | 0.011 | — | — | — | — | balance |
| 21 | 44.8 | 1.4 | 1.6 | 0.0003 | 0.025 | 0.24 | 0.014 | 0.26 | 0.27 | 0.041 | —* | 0.011 | 0.0043 | 0.006 | — | — | — | — | balance |
| 22 | 44.8 | 0.9 | 1.6 | 0.0024 | 0.012 | 0.06 | 0.013 | 0.78 | 0.73 | 0.020 | 0.053* | 0.041 | 0.0010 | 0.023 | — | — | — | — | balance |
| 23 | 44.9 | 1.4 | 1.6 | 0.0046 | 0.020 | 0.20 | 0.009 | 0.34 | 0.25 | 0.081 | 0.014 | —* | 0.0008 | 0.015 | — | — | — | — | balance |
| 24 | 43.5 | 1.7 | 1.6 | 0.0010 | 0.028 | 0.25 | 0.014 | 0.29 | 0.60 | 0.062 | 0.036 | 0.105* | 0.0037 | 0.017 | — | — | — | — | balance |
| 25 | 43.5 | 1.4 | 1.6 | 0.0012 | 0.009 | 0.27 | 0.015 | 0.71 | 0.53 | 0.087 | 0.012 | 0.074 | —* | 0.014 | — | — | — | — | balance |
| 26 | 43.7 | 1.7 | 1.7 | 0.0039 | 0.027 | 0.22 | 0.021 | 0.22 | 0.59 | 0.032 | 0.014 | 0.067 | 0.0110* | 0.009 | — | — | — | — | balance |
| 27 | 44.9 | 1.0 | 1.6 | 0.0028 | 0.027 | 0.10 | 0.024 | 0.12 | 0.81 | 0.083 | 0.017 | 0.086 | 0.0040 | —* | — | — | — | — | balance |
| 28 | 44.9 | 1.8 | 1.6 | 0.0026 | 0.030 | 0.11 | 0.017 | 0.58 | 0.27 | 0.016 | 0.013 | 0.026 | 0.0031 | 0.053* | — | — | — | — | balance |

(Note 1)
Each of Comparative Ni-based alloys does not contain any of Mo, W, Ca, and Ta.
(Note 2)
Asterisk (*) indicates out of range of composition of the present invention.

TABLE 6

| Conventional Ni-based alloy (mass %) | | | | | | | | | | | | | | | | | | | |
|---|---|---|---|---|---|---|---|---|---|---|---|---|---|---|---|---|---|---|---|
| Conventional Ni-based alloy | Composition | | | | | | | | | | | | | | | | | | |
| | Cr | Mo | W | Nb | Ti | Mg | N | Mn | Si | Fe | Co | Cu | Al | B | Ta | Ca | S | P | Ni + inevitable impurities |
| 1 | 19.2 | 2.9 | — | 4.9 | 0.9 | — | — | 0.15 | 0.110 | 17.9 | 0.25 | 0.130 | 0.490 | 0.0021 | 0.070 | 0.020 | 0.003 | 0.001 | balance |
| 2 | 20.7 | 8.7 | — | 3.4 | 1.4 | — | — | 0.11 | 0.092 | 8.5 | — | — | 0.105 | — | — | 0.009 | 0.005 | 0.008 | balance |
| 3 | 21.3 | 17.2 | 0.3 | — | — | — | — | 0.62 | 0.047 | 1.2 | 0.14 | — | 0.413 | — | — | 0.002 | 0.001 | 0.001 | balance |

1) Hot Forged Samples:

Each of Ni-based alloys 1 to 46 of the present invention shown in Tables 1 to 3, and Comparative Ni-based alloys 1 to 28 shown in Tables 4 and 5 was subjected to a homogenizing heat treatment at 1230° C. for 10 hours, and then, was cooled by water in the previous step. Each of the alloys was then heated at 1230° C. in an air atmosphere furnace, and after being retained for 1 hour, the bar was taken out from the furnace, followed by hot forging with a hammer while tightening with a tap in the range of from 900° C. to 1230° C. In the middle of the forging, the temperature might decrease below 900° C. before obtaining a predetermined shape. At that time, the bar was heated again in the furnace at 1230° C., retained for 15 min, followed by the hot forging.

The reheating in the furnace at 1230° C. and the hot forging were repeated several times, and finally, three bars of 20 mm diameter×1000 mm were formed. Alloys with significant cracks occurred in this process (hereinafter, referred to as "forged cracked product") are indicated in Tables 10 and 11 as "present", that is, the cracks were present after forging, and such alloys were not used in the evaluation described later. Each of the remaining alloys without occurrence of any problems in the hot forging was retained at 1230° C. for 30 minutes, followed by being cooled with water, and thereby a solution heat-treated material was obtained.

2) Hardness Comparison of Solution Heat-Treated Materials

From each of the end portions of the round bar of 20 mm diameter (solution heat-treated material) of each of Ni-based alloys 1 to 46 of the present invention shown in Tables 1 to 3, and Comparative Ni-based alloys 1 to 28 shown in Tables 4 and 5 (except for forged cracked products), the round bar was cut by 10 mm from its outermost end with large roughness to obtain a sample of 20 mm diameter×10 mm length. Each of the end portions of the round bar was polished eventually to #1000 using a waterproof emery paper. Then, Vickers hardness was measured with a load of 10 kg. The test results are shown in Tables 7 to 11. The hardness of each sample was measured at five points, and the average hardness of three points with the exception of two points respectively having the maximum and minimum hardness was shown as the result. Here, the hardness suitable for machining is approximately 200 HV.

3) Evaluation for Hot Forgeability

From the round bars (solution heat-treated material) of 20 mm diameter of the Ni-based alloys 1 to 46 of the present invention shown in Tables 1 to 3, and Comparative Ni-based alloys 1 to 28 shown in Tables 4 and 5 (except forged cracked products), round-bar tensile specimens (68 mm in total length; parallel portion having a diameter of 6 mm and a length of 15 mm) were formed. These tensile specimens were subjected to a high speed tensile test under a high temperature simulating forging conditions. That is, only the specimens were heated at 1230° C. by direct energization, retained for 5 minutes, and then the current supplied is lowered. Subsequently, the specimens were cooled at 5° C./min to 1100° C., retained for 60 seconds, and then subjected to a tensile test at high speed at 30 mm/sec.

After occurrence of a fracture, the diameter at the site of the fracture was measured, reduction of area (reduction of area $\delta=100\ (d\times d-d'\times d')/(d\times d)$ (%), where d is a diameter before testing, d' is a diameter after testing) was calculated, and the results are shown in Tables 7 to 11. The reduction of area in this high speed tensile test can be an index for determining the deformability in a high temperature environment. In general, when assuming a large ingot, it is necessary to have a reduction of area of 60% or more.

4) 0.2% Proof Stress by Tensile Test of Aging Heat-Treated Material

Each of the round bars (solution heat-treated material) of 20 mm diameter of the Ni-based alloys 1 to 46 of the present invention shown in Tables 1 to 3, and Comparative Ni-based alloys 1 to 28 shown in Tables 4 and 5 (except for forged cracked products) was retained at 700° C. for 30 hours, and then, was air cooled to obtain an aging heat-treated material. From the aging heat-treated materials of the Ni-based alloys 1 to 46 of the present invention and Comparative Ni-based alloys 1 to 28 (except for forged cracked products), and from Conventional Ni-based alloys 1 to 3 shown in Table 6 (aging heat-treated material), tensile specimens (ASTM E8 Small Size: 90 mm in total length; parallel portion having a diameter of 6.35 mm, a length of 36 mm, and a gauge length of 25.4) were respectively formed. Each of the specimens was subjected to a tensile test at a room temperature under a condition based on ASTM to measure 0.2% proof stress. That is, 0.2% proof stress was determined under the condition in which the strain rate of the specimen uniform part is set to be 0.005 (mm/mm)/min. The test results are shown in Tables 7 to 12. The Ni-based alloys of the present invention are required to have 0.2% proof stress of 1200 MPa or more which exceeds that of the conventional high-strength high corrosion resistant alloys.

5) Evaluation for Corrosion Resistance

The PRE (pitting resistance equivalent) value calculated from the chemical composition of each of the Ni-based alloys 1 to 46 of the present invention shown in Tables 1 to 3, Comparative Ni-based alloys 1 to 28 shown in Tables 4 and 5 (except for forged cracked products) and Conventional Ni-based alloys 1 to 3 shown in Table 6 is shown in Tables 7 to 12. Each of the Ni-based alloys of the present invention has a PRE (pitting resistance equivalent) value of about 45 at the minimum. In contrast, Conventional Ni-based alloy 1 has a PRE value of 31, and Conventional Ni-based alloy 2 has a PRE value of 39. Thus, each of the Ni-based alloys of the present invention has a PRE value that is greater than that of Conventional Ni-based alloys 1 and 2. Furthermore, although Conventional Ni-based alloy 3 has a PRE value of 47, each of the Ni-based alloys of the present invention has a PRE value that is equivalent to that of Conventional Ni-based alloy 3. Therefore, the object of the present invention can be achieved.

A corrosion test was carried out so as to confirm that the Ni-based alloy of the present invention actually has a corrosion resistance that exceeds the corrosion resistance of UNS N07718 which is a Conventional Ni-based alloy. From the round bars that have been subjected to an aging heat treatment, plates of 20 mm diameter×3 mm were obtained by cutting, and the entire surfaces of these plates were polished and finished with waterproof emery paper #1000, so that corrosion specimens were obtained. Regarding Conventional Ni-based alloys 1 to 3, from commercially available round bars (aging heat treated products), plates having the same size as that of the specimens of the present invention were obtained by cutting and then, polished and finished in the same manner as that of the present invention, so that corrosion specimens for Conventional Ni-based alloys 1 to 3 were obtained. A corrosion test was carried out as follows: a specimen was dipped in an aqueous solution of 6% $FeCl_3$+1% HCl (ASTM G48 Method C solution) for 72 hours, which was maintained at 80° C.; and the occurrence of pitting corrosion was confirmed after the test. The test results are shown in Tables 7 to 12.

TABLE 7

| Present invention Ni-based alloy | PRE | Presence of crack after forging | Hardness prior to aging (HV) | Reduction of area in high speed tensile test (%) | 0.2% proof stress after aging (MPa) | Presence of occurrence of pitting corrosion |
|---|---|---|---|---|---|---|
| 1 | 46.1 | absent | 189 | 85 | 1,357 | absent |
| 2 | 45.2 | absent | 184 | 89 | 1,255 | absent |
| 3 | 46.1 | absent | 193 | 88 | 1,305 | absent |
| 4 | 45.8 | absent | 208 | 86 | 1,236 | absent |
| 5 | 47.3 | absent | 214 | 62 | 1,332 | absent |
| 6 | 46.3 | absent | 193 | 72 | 1,215 | absent |
| 7 | 46.5 | absent | 221 | 79 | 1,365 | absent |
| 8 | 46.5 | absent | 187 | 78 | 1.215 | absent |
| 9 | 44.9 | absent | 218 | 76 | 1,321 | absent |
| 10 | 47.3 | absent | 191 | 61 | 1,243 | absent |
| 11 | 46.7 | absent | 195 | 62 | 1,274 | absent |
| 12 | 46.4 | absent | 189 | 61 | 1,269 | absent |
| 13 | 47.0 | absent | 219 | 62 | 1,285 | absent |
| 14 | 46.3 | absent | 196 | 61 | 1,250 | absent |
| 15 | 47.4 | absent | 215 | 61 | 1,274 | absent |
| 16 | 46.8 | absent | 204 | 61 | 1,275 | absent |

TABLE 8

| Present invention Ni-based alloy | PRE | Presence of crack after forging | Hardness prior to aging (HV) | Reduction of area in high speed tensile test (%) | 0.2% proof stress after aging (MPa) | Presence of occurrence of pitting corrosion |
|---|---|---|---|---|---|---|
| 17 | 47.1 | absent | 194 | 61 | 1,289 | absent |
| 18 | 46.4 | absent | 190 | 61 | 1,249 | absent |
| 19 | 46.3 | absent | 195 | 67 | 1,263 | absent |
| 20 | 46.9 | absent | 197 | 62 | 1,243 | absent |
| 21 | 46.7 | absent | 227 | 88 | 1,328 | absent |
| 22 | 46.6 | absent | 201 | 62 | 1,245 | absent |
| 23 | 46.7 | absent | 213 | 62 | 1,288 | absent |
| 24 | 46.0 | absent | 186 | 74 | 1,207 | absent |
| 25 | 46.5 | absent | 229 | 62 | 1,349 | absent |
| 26 | 46.3 | absent | 201 | 61 | 1,267 | absent |
| 27 | 46.4 | absent | 198 | 62 | 1,247 | absent |
| 28 | 46.6 | absent | 188 | 61 | 1,253 | absent |
| 29 | 46.5 | absent | 202 | 61 | 1,244 | absent |
| 30 | 46.9 | absent | 201 | 61 | 1,260 | absent |
| 31 | 46.1 | absent | 196 | 61 | 1,241 | absent |

TABLE 9

| Present invention Ni-based alloy | PRE | Presence of crack after forging | Hardness prior to aging (HV) | Reduction of area in high speed tensile test (%) | 0.2% proof stress after aging (MPa) | Presence of occurrence of pitting corrosion |
|---|---|---|---|---|---|---|
| 32 | 46.3 | absent | 203 | 84 | 1,277 | absent |
| 33 | 48.1 | absent | 228 | 80 | 1,325 | absent |
| 34 | 46.1 | absent | 199 | 77 | 1,280 | absent |
| 35 | 48.6 | absent | 226 | 71 | 1,322 | absent |
| 36 | 47.2 | absent | 217 | 80 | 1,307 | absent |
| 37 | 46.8 | absent | 189 | 71 | 1,278 | absent |
| 38 | 46.7 | absent | 191 | 74 | 1,243 | absent |
| 39 | 46.8 | absent | 190 | 65 | 1,251 | absent |
| 40 | 47.0 | absent | 191 | 68 | 1,247 | absent |
| 41 | 47.4 | absent | 185 | 70 | 1,208 | absent |
| 42 | 47.0 | absent | 219 | 69 | 1,297 | absent |
| 43 | 47.2 | absent | 212 | 73 | 1,312 | absent |
| 44 | 49.3 | absent | 228 | 70 | 1,344 | absent |
| 45 | 47.2 | absent | 200 | 84 | 1,319 | absent |
| 46 | 47.7 | absent | 218 | 82 | 1,313 | absent |

TABLE 10

| ComparAtive Ni-based alloy | PRE | Presence of crack after forging | Hardness prior to aging (HV) | Reduction of area in high speed tensile test (%) | 0.2% proof stress after aging (MPa) | Presence of occurrence of pitting corrosion |
|---|---|---|---|---|---|---|
| 1 | 43.5 | absent | 181 | 87 | 1,150 | absent |
| 2 | 44.9 | present | — | — | — | — |
| 3 | 45.9 | absent | 180 | 89 | 1,112 | absent |
| 4 | 49.5 | present | — | — | — | — |
| 5 | 47.9 | absent | 182 | 83 | 1,127 | absent |
| 6 | 45.0 | present | — | — | — | — |
| 7 | 46.7 | absent | 184 | 55 | 1,264 | absent |
| 8 | 47.2 | absent | 186 | 49 | 1,207 | absent |
| 9 | 46.0 | absent | 187 | 51 | 1,214 | absent |
| 10 | 47.2 | present | — | — | — | — |
| 11 | 46.8 | absent | 186 | 54 | | absent |
| 12 | 46.1 | absent | 183 | 77 | 1,165 | absent |
| 13 | 45.9 | present | — | — | — | — |
| 14 | 46.1 | present | — | — | — | — |
| 15 | 46.4 | present | — | — | — | — |

TABLE 11

| ComparAtive Ni-based alloy | PRE | Presence of crack after forging | Hardness prior to aging (HV) | Reduction of area in high speed tensile test (%) | 0.2% proof stress after aging (MPa) | Presence of occurrence of pitting corrosion |
|---|---|---|---|---|---|---|
| 16 | 47.1 | absent | 205 | 56 | | absent |
| 17 | 45.7 | present | — | — | — | — |
| 18 | 45.4 | absent | 256 | 57 | 1,217 | absent |
| 19 | 48.2 | absent | 194 | 51 | 1,243 | absent |
| 20 | 47.7 | present | — | — | — | — |
| 21 | 47.6 | absent | 186 | 76 | 1,171 | absent |
| 22 | 46.5 | present | — | — | — | — |
| 23 | 47.7 | present | — | — | — | — |
| 24 | 47.0 | absent | 198 | 53 | 1,263 | absent |
| 25 | 45.8 | present | — | — | — | — |
| 26 | 47.0 | present | — | — | — | — |
| 27 | 47.2 | present | — | — | — | — |
| 28 | 48.5 | present | — | — | — | — |

TABLE 12

| Conventional Ni-based alloy | PRE | Presence of crack after forging | Hardness prior to aging (HV) | Reduction of area in high speed tensile test (%) | 0.2% proof stress after aging (MPa) | Presence of occurrence of pitting corrosion |
|---|---|---|---|---|---|---|
| 1 | 30.9 | —* | —* | —* | 924 | present |
| 2 | 38.8 | —* | —* | —* | 1,043 | absent |
| 3 | 47.6 | —* | —* | —* | 803 | absent |

(Note)
Asterisk (*) shows that the test was not carried out because commercially available aging heat-treated products were purchased.

In view of the above results, each of the Ni-based alloys 1 to 46 of the present invention has a corrosion resistance that is superior to that of Conventional Ni-based alloy 1, and has a corrosion resistance that is equivalent to that of Conventional Ni-based alloys 2 and 3. Furthermore, it can be confirmed that each of the Ni-based alloys 1 to 46 of the present invention has 0.2% proof stress that is far greater than that of Conventional Ni-based alloys. In addition, as compared with the Ni-based alloys of the present invention, Comparative Ni-based alloys 1 to 28 are inferior in corrosion resistance, inferior in hot forgeability, such as cracking during hot forging process or smaller deformability (reduction of area) at a temperature of 1100° C., or inferior in 0.2% proof stress at a room temperature.

As shown above, the Ni-based alloys 1 to 46 of the present invention have high strength and excel in hot forgeability as well as corrosion resistance. Thus, the Ni-based alloys 1 to 46 of the present invention are suitable for a N-based alloy required for the outer members of drill members in deep water and deep underground.

INDUSTRIAL APPLICABILITY

As described above, the Ni-based alloy of the present invention excels particularly in 0.2% proof stress, has a corrosion resistance that is equivalent to that of conventional members, and also excels in hot forgeability. Thus, by using the Ni-based alloy of the present invention, it becomes possible to manufacture a large forged member, for example, a material having a greater diameter and length.

Therefore, according to the Ni-based alloy of the present invention, drill members that enable drilling in deep water or deep underground, in which improved hot forgeability, high strength and high corrosion resistance are required, can be provided. Furthermore, since the Ni-based alloy of the present invention has excellent hot forgeability, the strength can be improved after the alloy has been formed into a shape. Thus, products having a complicated shape in which high strength is required can be easily manufactured, so that it is expected as a new material that can be applied in a new field.

The invention claimed is:

1. A Ni-based alloy suitable for hot forgeability, the Ni-based alloy having a composition consisting of, by mass %, 42.1 to 45.5% of Cr,
0.5 to 2.5% of Nb,
1.2 to 2.0% of Ti,
0.0001 to 0.0090% of Mg,
0.001 to 0.040% of N,
0.01 to 0.50% of Mn,
0.001 to 0.050% of Si,
0.01 to 1.00% of Fe,
0.01 to 2.50% of Co,
0.001 to less than 0.500% of Cu,
0.001 to 0.050% of Al,
0.005 to less than 0.100% of V,
0.0001 to 0.0100% of B,
0.001 to 0.050% of Zr,
optionally 0.1 to 1.5% of Mo,
optionally 0.1 to 1.5% of W,
optionally 0.001 to less than 0.050% of Ca,
optionally 0.001 to less than 0.050% of Ta, and
the balance of Ni with inevitable impurities.

2. A member for oil drilling comprising the Ni-based alloy according to claim 1.

3. The Ni-based alloy according to claim 1, wherein molybdenum is present in an amount of 0.1 to 1.5% by mass and/or tungsten is present in an amount of 0.1 to 1.5% by mass.

4. The Ni-based alloy according to claim 3, wherein calcium is present in an amount of 0.001 to less than 0.050% by mass.

5. The Ni-based alloy according to claim 3, wherein tantalum is present in an amount of 0.001 to less than 0.050% by mass.

6. A member for oil drilling comprising the Ni-based alloy according to claim 3.

7. The Ni-based alloy according to claim 1, wherein calcium is present in an amount of 0.001 to less than 0.050% by mass.

8. The Ni-based alloy according to claim 7, wherein tantalum is present in an amount of 0.001 to less than 0.050% by mass.

9. A member for oil drilling comprising the Ni-based alloy according to claim 7.

10. The Ni-based alloy according to claim 1, wherein tantalum is present in an amount of 0.001 to less than 0.050% by mass.

11. A member for oil drilling comprising the Ni-based alloy according to claim 10.

* * * * *